US005630463A

United States Patent [19]

Shimmell

[11] Patent Number: 5,630,463

[45] Date of Patent: May 20, 1997

[54] VARIABLE VOLUME DIE CASTING SHOT SLEEVE

[75] Inventor: Dennis S. Shimmell, Hudsonville, Mich.

[73] Assignee: Nelson Metal Products Corporation, Grandville, Mich.

[21] Appl. No.: 351,937

[22] Filed: Dec. 8, 1994

[51] Int. Cl.[6] ..... B22D 17/08; B22D 17/32

[52] U.S. Cl. ..... 164/312; 164/314

[58] Field of Search ..... 164/312, 313, 164/314, 315

[56] References Cited

U.S. PATENT DOCUMENTS

| | | | |
|---|---|---|---|
| 359,757 | 3/1887 | Wicks | 164/120 |
| 2,137,764 | 11/1938 | Wagner . | |
| 2,479,433 | 8/1949 | Tucker | 164/314 X |
| 2,972,172 | 2/1961 | Federman . | |
| 3,019,495 | 2/1962 | Cornell . | |
| 3,292,218 | 12/1966 | Kozma, Jr. . | |
| 3,646,990 | 3/1972 | Cross . | |
| 3,791,440 | 2/1974 | Cross . | |
| 3,810,505 | 5/1974 | Cross . | |
| 4,252,176 | 2/1981 | Page | 164/312 X |
| 4,436,140 | 3/1984 | Ebisawa et al. . | |
| 4,505,318 | 3/1985 | Tokui et al. . | |
| 4,519,436 | 5/1985 | Ebisawa et al. . | |
| 4,530,391 | 7/1985 | Fink et al. | 164/312 X |
| 4,614,630 | 9/1986 | Pluim, Jr. . | |
| 4,730,658 | 3/1988 | Nakano . | |
| 5,052,468 | 10/1991 | Koenig | 164/315 X |
| 5,205,338 | 4/1993 | Shimmell | 164/312 X |
| 5,365,999 | 11/1994 | Stummer et al. | 164/312 X |

FOREIGN PATENT DOCUMENTS

| | | | |
|---|---|---|---|
| 565457 | 3/1960 | Belgium . | |
| 532743 | 11/1921 | France | 164/314 |
| 935147 | 10/1955 | Germany . | |
| 58-196159 | 11/1983 | Japan . | |
| 60-102259 | 6/1985 | Japan . | |
| 168897 | 10/1959 | Sweden . | |
| 984659 | 1/1983 | U.S.S.R. | 164/312 |

*Primary Examiner*—J. Reed Batten, Jr.
*Attorney, Agent, or Firm*—Warner Norcross & Judd

[57] ABSTRACT

A variable volume metal delivery system for a die casting machine. The system includes a shot sleeve having a plunger propelled by a shot cylinder. A stroke adjustment rod operated by a second cylinder extends into the shot cylinder to define the backward stroke limit of the shot cylinder and consequently that of the plunger. The stroke adjustment rod is movable by means of the second cylinder between a high-volume position, permitting a relatively long stroke, and a low-volume position, providing a relatively short stroke. Accordingly, the volume of the shot sleeve can be changed easily, for example, to accommodate the manufacture of articles either with or without structural inserts.

11 Claims, 4 Drawing Sheets

VARIABLE VOLUME DIE CASTING SHOT SLEEVE

BACKGROUND OF THE INVENTION

The present invention relates to die casting equipment and more particularly to a shot sleeve through which the molten metal is transferred into the die.

Die casting is a common used technology for manufacturing metal articles. Typically, the die casting apparatus includes a pair of die halves each formed with a void corresponding to a portion of the article to be cast. When the two die halves are brought together in proper alignment, their respective voids cooperate to form a die cavity corresponding to the shape of the article to be cast. Molten material is introduced into the die and allowed to cure—typically by cooling the molten material to allow it to solidify. Once the material is sufficiently cured, the die halves are opened and the cast article is removed.

The die cast machine includes a shot sleeve to inject the molten metal into the die cavity. The shot sleeve defines an internal bore communicating with the die cavity. A plunger reciprocates within the shot sleeve to inject or force the molten metal into the die cavity. The plunger is connected to a hydraulic cylinder by a plunger rod. Extension of the plunger injects the molten metal within the sleeve into the die cavity. Retraction of the plunger withdraws the plunger to permit filling the sleeve for the next shot.

It is desirable to match the volume of the shot sleeve to the amount of metal required for a single shot into the die. Accordingly, the outer end of the shot cylinder includes a threaded stroke adjuster, which permits fine tuning of the position of the retracted plunger and therefore the volume of the shot cylinder. Turning the stroke adjuster makes small changes in the stroke length and consequently the internal volume of the shot sleeve. These minor adjustments may be necessary, for example, to compensate for expansion or contraction of the die: components or for slight variations from design specifications.

During the first shots as a die casting machine is first used, the die casting mold warms up to a proper operating temperature. Because an inadequately heated die produces low quality castings, the articles cast during warm-up are either recycled or scrapped. Obviously, this process is undesirably wasteful and costly, but cannot be avoided.

Die cast techniques vary in part depending on the desired strength of the article. One technique, providing comparable strength and wear with lighter weight than cast iron and steel articles, is to include a structural insert in an aluminum die cast article. Such inserts are typically formed from cast iron, steel, or precast aluminum and are placed in the die cavity prior to die casting so that they are encapsulated by moltan material to become an integral part of the article. For example, an insert may be located in a high stress portion of an article to bolster the casting or along contact surfaces to prevent coining or wear of the article.

When inserts are used, they are wasted during die warm-up. As noted above, articles cast during the warm-up period are discarded or recycled because they are of inferior quality. Consequently, the inserts used during the warm-up castings also are discarded. This is both wasteful and expensive, because the inserts usually comprise a significant portion of the cost of the cast article.

Conventional die casting equipment undergoes a pressure spike at the end of each shot when the die cavity is filled as the shot plunger continues to move forward. This pressure spike is distributed throughout various die casting components and potentially leads to metal fatigue and ultimately failure. One known method for cushioning this pressure spike is to provide a relief hydraulic cylinder having a relief plunger that extends into the gate at the junction of the shot sleeve and the die. When the die cavity is filled, the metal pushes the relief plunger backwards in the cylinder. Immediately following this cushioning, the relief cylinder returns the relief plunger to its original position. This method requires additional components and machining, decreases the reliability of the die caster, and adds additional conventional problems associated with the fluid metal in contact with the plunger.

SUMMARY OF THE INVENTION

The present invention overcomes these problems by providing a variable volume shot sleeve that includes a volume control cylinder for adjusting the volume of the shot sleeve by varying the stroke length of the shot cylinder and consequently the stroke length of the shot sleeve plunger.

As disclosed, the variable volume shot sleeve includes a conventional shot sleeve and shot cylinder arrangement. A volume control cylinder that controls the position of a stroke adjustment rod is mounted to the outer end of the shot cylinder. The stroke adjustment rod extends into the shot cylinder to define the outer stroke limit of the shot cylinder piston and consequently that of the shot sleeve plunger.

In a preferred embodiment, the volume control cylinder is movable between a high-volume position and a low-volume position. In the high-volume position, the stroke adjustment plunger is fully retracted to allow full retraction of the shot sleeve plunger thereby increasing the volume of the shot sleeve. In the low volume position, the stroke adjustment rod is extended to allows only partial retraction of the plunger thereby reducing the volume of the shot sleeve.

In a more preferred embodiment, the outer end of the stroke adjustment rod is threadedly engaged with the volume control cylinder to allow fine adjustment of the shot size and stroke length.

The present invention provides a simple and effective method and apparatus for quickly and accurately varying the volume of the shot sleeve. This feature permits different volumes of metal to be introduced into a single die. This is useful, for example, during die warm-up for parts that include inserts. During warm-up, the cylinder is set in the high-volume position; and the inserts are omitted. As the die casting machine is operated in this configuration, the die is completely filled and gradually warmed; but inserts do not need to be installed in the warm-up, waste articles. After the die is warm, the cylinder is shifted to the low-volume position; and inserts are positioned within the die to operate in conventional fashion.

When in the low-volume position, the volume control cylinder also cushions the pressure spike arising when the die cavity is completely filled. Specifically, the hydraulic fluid in the volume control cylinder shifts to partially dissipate the pressure spike.

The volume control cylinder, when properly dimensioned, is readily adapted to existing die casting equipment. Specifically, the cylinder simply replaces the stroke adjuster of the prior art, while as noted above continuing to provide a stroke adjustment feature in the more preferred embodiment.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
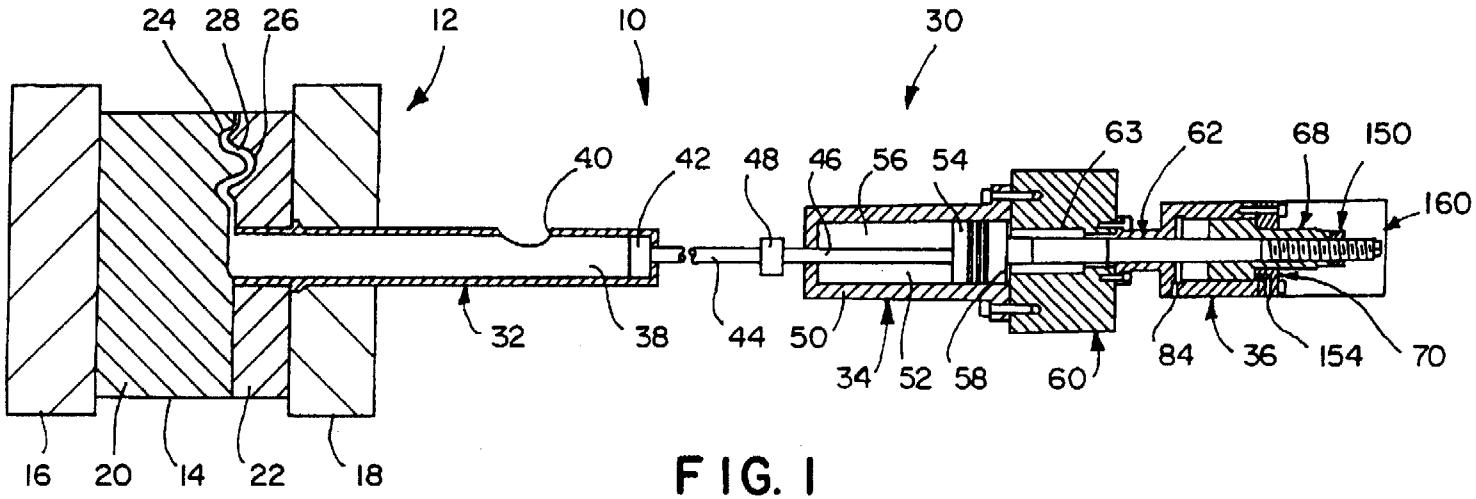
FIG. 1 is a sectional, side elevational view of a die casting apparatus according to the present invention with the volume control cylinder in the high-volume position and the shot sleeve plunger fully retracted.

By way of disclosure and not by way of limitation, a die casting apparatus, or machine, incorporating a variable volume shot sleeve is shown in FIG. 1 and generally designated 10. The apparatus includes a die assembly 12 defining the shape of an object to be cast and a metal delivery system 30 for forcing molten metal into the die assembly to create cast metal objects. While the present invention is described in connection with a horizontal casting system, the present invention is equally well suited for use with vertical casting systems. The terms outer and inner are used herein as expedients to describe the direction away from and toward the die assembly 12, respectively. Similarly, the terms retraction and extension are used as expedient to describe movement away from and toward the die assembly, respectively.

Referring to FIG. 1, the die assembly 12 is generally well know to those having skill in the art and includes a die 14, a movable platen 16, and a stationary platen 18. The die 14 includes an ejector die 20 mounted to the movable platen 16 and a cover die 22 mounted to the stationary platen 18. The inner surface 24 of the ejector die 20 is contoured to match a portion of the profile of the article to be cast. Similarly, the inner surface 26 of the cover die 22 is contoured to match the remaining portion of the profile of the article to be cast. When the ejector die 20 and cover die 22 are brought together, the contoured inner surfaces 24 and 26 cooperate to form a void or die cavity 28 which defines the shape of the article to be cast. Preferably, the movable platen 16 is mounted to conventional hydraulic means (not shown) to provide the movable platen 16 and ejector die 20 with appropriate movement. In more complex casting systems, the profile of the article to be cast may be defined by more than two dies.

The metal delivery system 30 generally includes a shot sleeve 32, a shot cylinder 34, and a volume control cylinder 36. The shot sleeve 32 and the shot cylinder 34 also are both generally well know to those having skill in the art.

The shot sleeve 32 is mounted in the stationary platen 18 and the cover die 22. The shot sleeve 32 is generally cylindrical and includes a concentric internal bore 38 than is in fluid communication with the die cavity 28. A filling hole 40 is formed through the upper surface of the shot sleeve 32 in fluid communication with internal bore 38. A plunger 42 seals off the outer end of the shot sleeve and reciprocates within internal bore 38 to inject molten metal into the die. The plunger 42 is connected to the shot cylinder 34 by a plunger rod 44.

Figure 2:
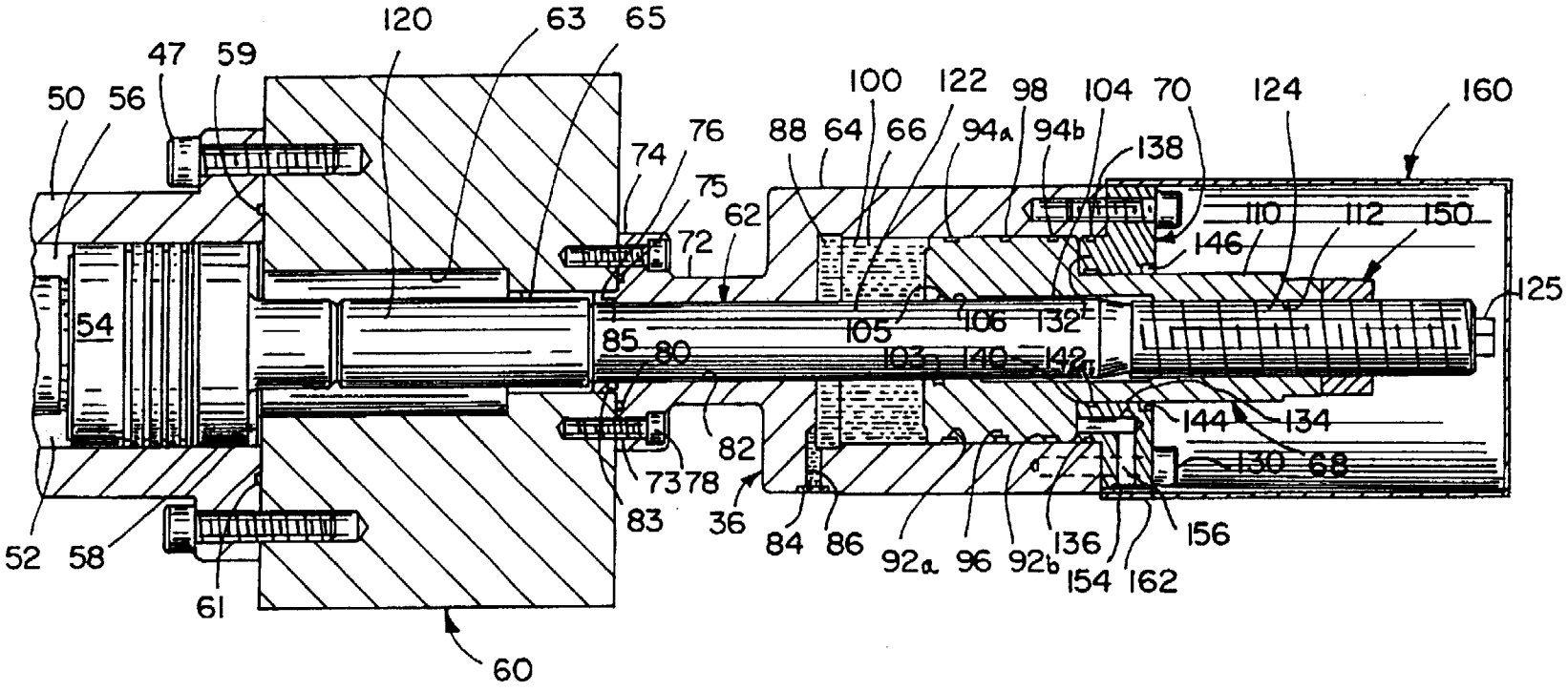
FIG. 2 is a sectional, side elevational view of the shot cylinder and the volume control cylinder in the high-volume position.

The shot cylinder 34 is a generally conventional hydraulic cylinder having a reciprocating shot cylinder rod 46 which is connected to plunger rod 44 by cross head adapter 48. The shot cylinder 34 includes a cylindrical barrel 50 having a cylindrical internal bore 52, and a barrel cap 60 for capping and sealing off the outer end of the shot cylinder 34. Referring now to FIG. 2, a bore 63 extends through the barrel cap 50 and includes a reduced diameter portion 65 for seating the neck 72 of the volume control cylinder 36. The barrel cap 60 is secured to the barrel 50 by conventional fasteners, such as bolts 47. An O-ring 61, seated within annular recess 59, is sandwiched between the two components to provide a leak-tight seal.

A piston head 54 fits within the barrel 50 to separate the internal bore 52 into two chambers 56 and 58, with interdependent volumes depending on the position of the piston head. Conventional hydraulic fluid lines are connected to opposite ends of the shot cylinder to supply fluid to, and exhaust fluid from, the chambers 56 and 58. The piston head 54 reciprocates within internal bore 52 in response to the relative pressure of hydraulic fluid within chambers 56 and 58.

A stroke adjustment rod 62 extends through bore 63 into internal bore 52 to limit the backward stroke of piston head 54. The stroke adjustment rod 62 includes an inner portion 120, a central portion 122, and a outer portion 124. Inner portion 120 is somewhat larger in diameter than bore 82 to prevent over retraction of the stroke adjustment rod. The diameter of central portion 122 is slightly smaller than that of bore 82 so that rod 62 can move axially through the volume control cylinder 36. Outer portion 124 is threadedly engaged with the piston head 68 of the volume control cylinder 36 as described in greater detail below. The outer end 125 of the stroke adjustment rod 62 is squared, or otherwise surfaced, to provide a tool-receiving portion enabling the rod to be rotated.

Figure 4:
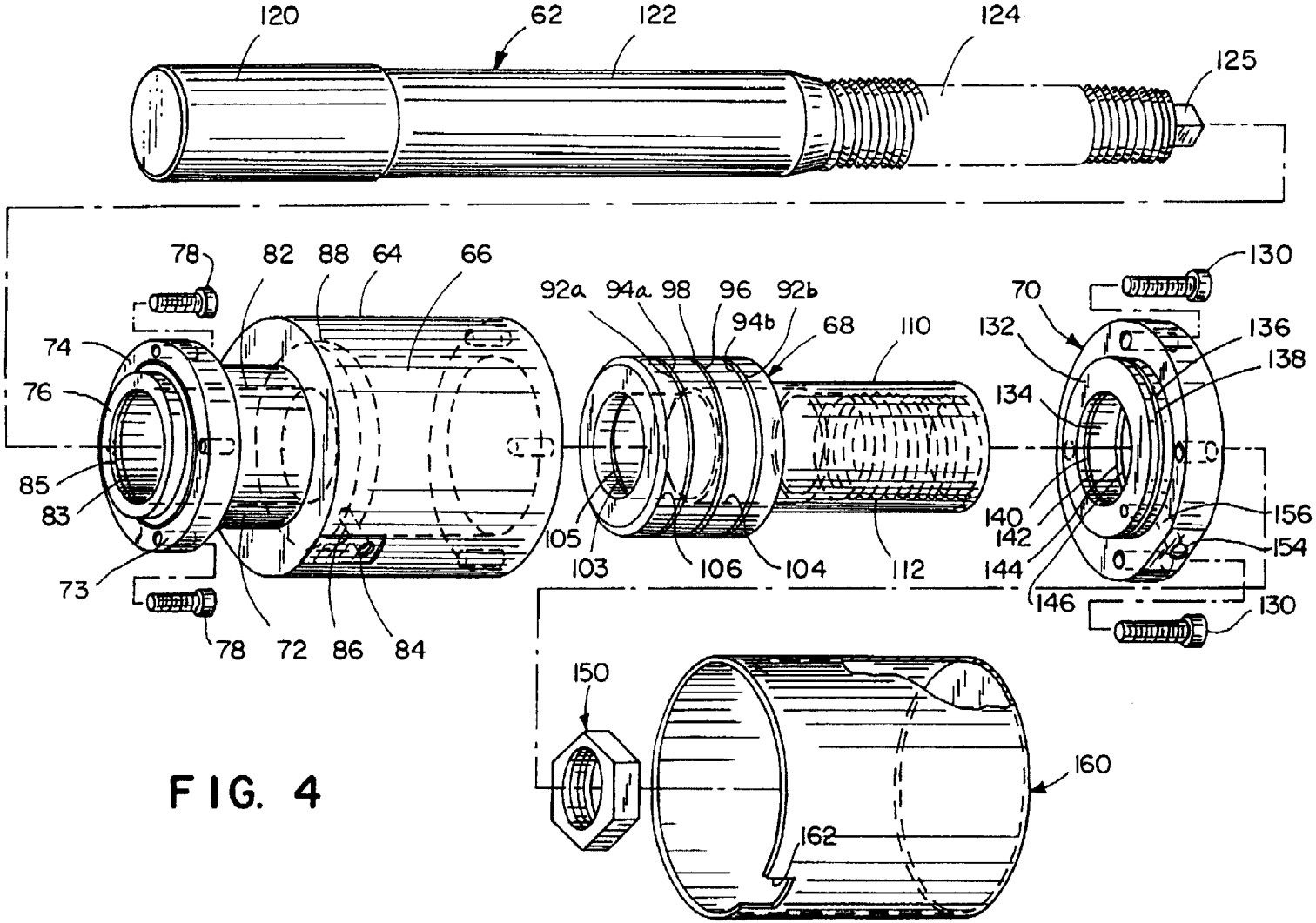
FIG. 4 is an exploded, perspective view of the volume control cylinder assembly.

As perhaps best illustrated in FIGS. 2 and 4, the volume control cylinder 36 is mounted to barrel cap 60 and generally includes a cylindrical barrel 64 having an internal bore 66, a piston head 68 seated within internal bore 66, and a barrel cap 70 for entrapping piston head 68 and sealing off the outer end of internal bore 66. A neck 72 extends from the inner end of barrel 64 and defines a longitudinally extending bore 82 dimensioned to snugly receive the central portion 122 of the stroke adjustment rod 62. An annular recess 85 is formed around bore 82 to seat a conventional seal 83 which provides a leak-tight seal between stroke adjustment rod 62 and neck 72. The inner end of the neck 72 includes a reduced diameter portion 76 dimensioned to fit within the reduced diameter portion 65 of bore 63 and a collar 74 having a number of mounting holes 73 and an annular recess 75. Barrel 64 is mounted to barrel cap 60 by bolts 78 extending through mounting holes 73. Barrel 64 and barrel cap 60 sandwich an O-ring 80 seated within recess 75 to provide a leak-tight seal. Barrel 64 further includes a threaded hydraulic fluid port 84 that communicates with internal bore 66 through passage 86. In addition, an annular recess 88 is formed at the inner end of the internal bore 66.

Piston head 68 is dimensioned to fit within barrel 64 and divide the internal bore 66 into two chambers 100 and 102 (See FIGS. 2 and 3), with interdependent volumes depending on the position of the piston head. The piston head 68 includes a pair of annular recesses **92*a* and 92*b* for seating wear rings 94*a* and 94*b*, which extend the life of the volume control cylinder by reducing piston head wear. A third annular recess 96 is disposed between recesses 92a and 92b. Seal 98 is seated in recess 96 to provide a leak-tight seal around the piston head 68 to prevent fluid communication between chambers 100 and 102. A concentric bore 104 extends longitudinally through the piston head 68 to receive stroke adjustment rod 62. The inner end of bore 104 includes a reduced diameter portion 106 which closely receives the stroke adjustment rod. An annular recess 105 is formed in portion 136 to seat an O-ring 103 for providing a leak-tight seal between stroke adjustment rod 62 and piston head 68. A stem 110 extends longitudinally outward from the outer end of piston head 68. A concentric, threaded bore 112 extends longitudinally through stem 110 to threadedly receive the outer portion 124 of the stroke adjustment rod 62**.

Barrel cap 70 mounts to the outer end of barrel 64 by conventional fasteners, such as bolts 130. The barrel cap 70 includes a short neck 132 that extends into internal bore 66. An annular recess 136 is formed around the outer surface of neck 132 to seat an O-ring 138 which provides a leak-tight seal between barrel 64 and barrel cap 70. A concentric bore 134 extends through barrel cap 70 to receive stem 110. An annular recess 140 is formed around bore 134 to seat a seal 142 which provides a leak-tight seal between stem 110 and barrel cap 70. The outer end of bore 134 includes an annular notch 144 for seating a rod uiper 146 which wipes stem 110 during extension and retraction of the stroke adjustment rod 62. Barrel cap 70 further includes a threaded hydraulic fluid port 154 that communicates with internal bore 66 through passage 156.

A jam nut 150 is threadedly seated on outer portion 124 of stroke adjustment rod 62. The jam nut 150 is tightened against stem 110 to prevent the stroke adjustment rod 62 from rotating.

Preferably, a cover 160 is provided to enclose the outer end of the volume control cylinder. Cover 160 is preferably friction fit over barrel cap 70 and includes an opening 162 to provide access to port 154.

ASSEMBLY AND OPERATION

Prior to assembling the die casting apparatus, a volume control cylinder 30 is fabricated having the length of stroke necessary to provide desired variation between the high-volume and low-volume shots. The volume control cylinder is mounted to the shot cylinder 34. The volume control cylinder 36 replaces a conventional barrel cap and stroke adjuster. Neck 72 mounts directly to barrel cap 60 by bolts 78. The stroke adjustment rod 62 extends from the volume control cylinder 36 into bore 63 formed in barrel cap 60. In this manner, the volume control cylinder can be easily mounted to new systems or retrofit to existing systems. For example, if the total volume of any article inserts is 10 cubic inches, then the volume control cylinder is manufactured to provide a 10 cubic inch variation in shot volume. If the shot sleeve 32 has an internal diameter of 2 inches, the necessary stroke variation is approximately 3.183 inches.

Operation of the present invention will be described in connection with the warm-up procedure of a die casting system configured to cast articles with inserts. As described below, fine volume control is effected by rotation of the threaded stroke adjustment rod, and gross volume control is effected by operation of the volume control cylinder 36. During warm-up, inserts are not placed into the die to reduce cost and avoid scrapping of the inserts in the warm-up articles of undesired quality. The volume of molten material shot into the die must be sufficient to compensate for the omitted inserts so that the die cavity is completely filled. Accordingly, the volume control cylinder is initially placed in the high-volume position, and a sufficient number of castings are made to bring the die up to operating temperature. After the die has reached its operating temperature, the volume of molten material shot into the die must be reduced "to normal" to compensate for the presence of inserts in the die cavity. Accordingly, the volume control cylinder is placed in the low-volume position to reduce the volume of the shot sleeve. While the present invention is described in connection with a warm-up procedure, it is equally well suited for use in any casting procedure that requires different volume levels of molten material. The process is described in greater detail in the following description.

Initially, the volume control cylinder 36 is retracted by supplying fluid to chamber 100. Retraction of the volume control cylinder 36 causes the stroke adjustment rod 62 to retract thereby increasing the outer stroke limit of the shot cylinder 34. As a result, the shot cylinder piston head 54 and consequently the shot sleeve plunger 42 can be fully retracted as shown in FIG. 1. Extension of piston head 54 continues until the piston head reaches the end of internal bore 52. Retraction of piston head 54 continues until the piston head engages stroke adjustment rod 62.

After the volume control cylinder 36 and shot cylinder 34 are retracted, molten material is ladled in to the shot sleeve 32. Once filled, the shot cylinder 34 is extended, forcing the plunger 42 toward the die and thereby injecting the molten material into the die cavity 28. Once the shot cylinder 34 is fully extended and the molten material is fully expelled from the shot sleeve 32, the shot cylinder 34 is retracted to prepare the shot sleeve 32 for the next shot; and the cast article is ejected from the die assembly 12. This cycle continues until the die reaches adequate operating temperature. All of the articles cast during the warm-up period without inserts are scrap that can be relatively easily recycled because of the absence of the inserts.

Figure 3:
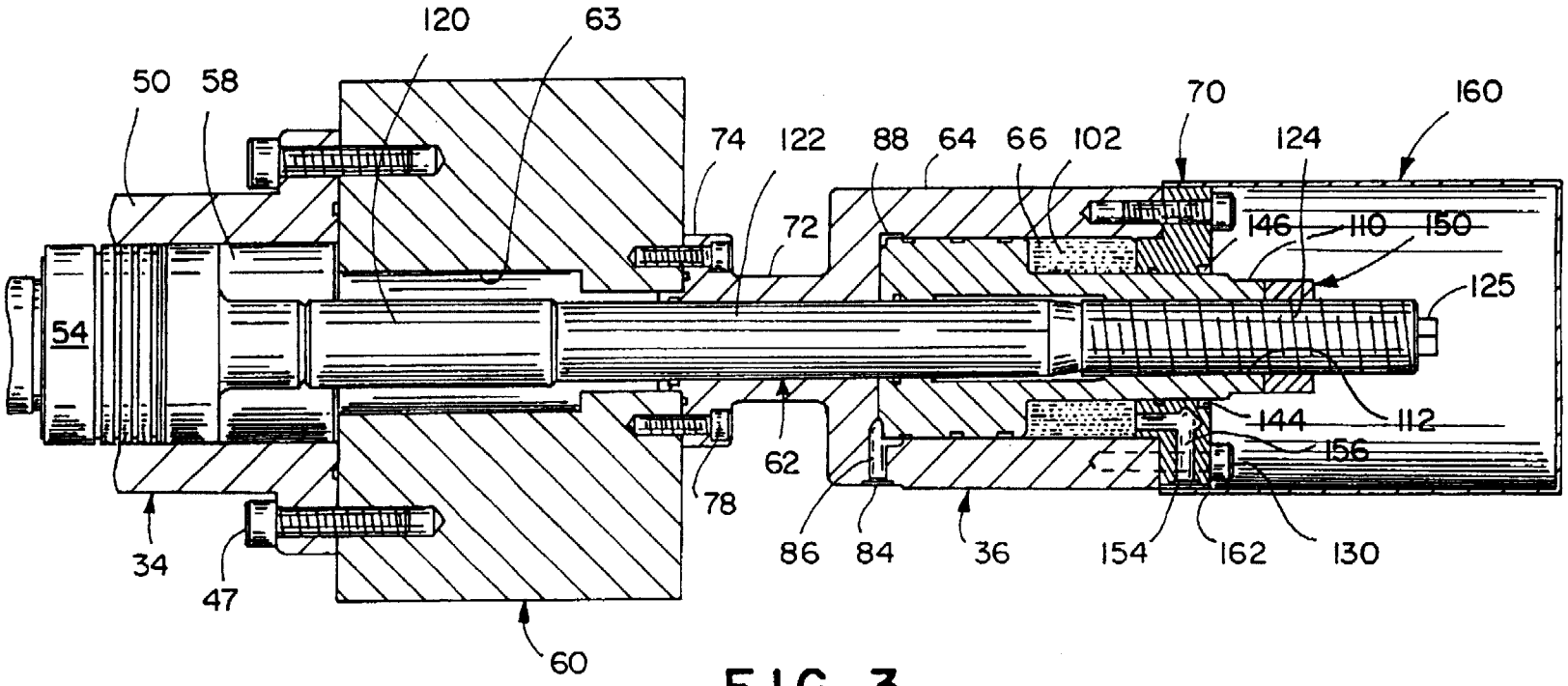
FIG. 3 is a sectional, side elevational view of the shot cylinder and the volume control cylinder in the low-volume position.

After the die has reached operating temperature, the volume control cylinder 36 is extended by supplying fluid pressure to chamber 102. As shown in FIG. 3, extension of the volume control cylinder 36 moves the stroke adjustment rod 62 further into the shot cylinder 34 to decrease the outer stroke limit of the shot cylinder 34. Consequently, the shot cylinder 34 and shot sleeve plunger 42 can only be partially retracted thereby reducing the effective volume of the shot sleeve 32.

Fine adjustments to the volume of the shot sleeve 32 may be made by loosening the jam nut 150 and rotating the stroke adjustment rod either clockwise to decrease the volume of the shot or counter-clockwise to increase the volume of the shot. Once properly adjusted, the jam nut 150 is tightened against the stem 110 to secure the stroke adjustment rod 62 in place.

Figure 5:
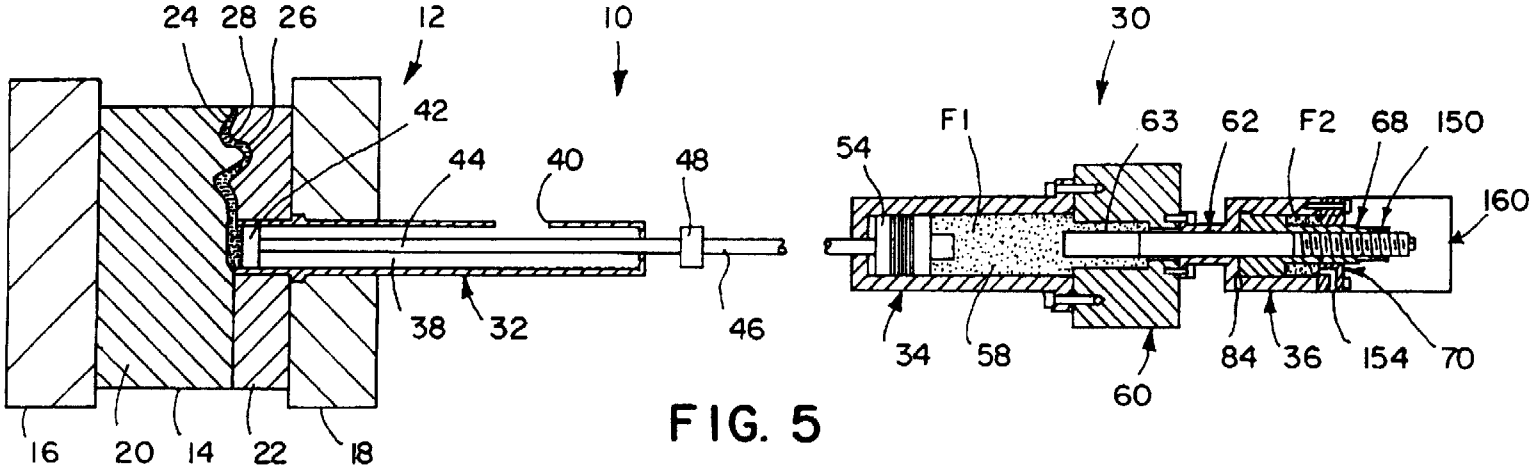
FIG. 5 is a sectional, side elevational view of the die casting apparatus with the volume control cylinder in the low volume position and the shot sleeve plunger fully extended.

Referring now to FIG. 5, the present invention also cushions the pressure spike incurred during injection when the die cavity 28 reaches full. During operation, the shot cylinder 34 is extended by supplying hydraulic fluid F1 to chamber 58. When the die cavity 28 reaches full, back-pressure in the die resists extension of the plunger 42 ultimately causing the pressure of fluid F1 to spike as additional fluid is supplied to chamber 58. This pressure spike can fatigue the die casting components and may lead to premature failure. When in the low-volume position, the volume control cylinder 36 functions to reduce the magnitude of this pressure spike. The pressure spike exerts force on the stroke adjustment rod 62 driving it away from the die assembly 12. The stroke adjustment rod 62 in turn distributes this force to the fluid F2 in chamber 102. The fluid F2 is compressed thereby expending a portion of the energy of the pressure spike. In effect, the compression of fluid F2 reduces the magnitude of the pressure spike and acts as a shock absorber.

The present invention is described in connection with fixed-stroke, two-position hydraulic cylinder. However, a conventional, variable-stroke cylinder may be used so that the volume control cylinder can be adjusted to supply a variety of volume variations.

The above description is that of a preferred embodiment of the invention. Various alterations and changes can be made without departing from the spirit and broader aspects of the invention as defined in the appended claims, which are to be interpreted in accordance with the principles of patent law, including the doctrine of equivalents.

The embodiments of the invention is which an exclusive property or privilege is claimed are defined as follows:

1. A variable volume metal delivery system for use in a die casting apparatus, comprising:

a shot sleeve defining an internal shot volume;

a plunger reciprocable within said shot sleeve between a retracted position wherein molten metal may be introduced into said shot sleeve and an extended position wherein metal is expelled from said shot sleeve, said plunger having an extended stroke limit and a retracted stroke limit;

gross volume control means for changing the retracted stroke limit of said plunger between a low-volume position and a high-volume position without varying the extended stroke limit of said plunger; and fine volume control means for providing fine adjustment of the retracted stroke limit of said plunger in both of the low-volume and high-volume position without varying the extended stroke limit of said plunger.

2. The metal delivery system of claim 1 further comprising a shot cylinder means for reciprocating said plunger within said shot sleeve, said shot cylinder means having a stroke equal to that of said plunger.

3. The metal delivery system of claim 1, wherein said gross volume control means includes a hydraulic cylinder having a reciprocating piston head and a stroke adjustment rod affixed to said piston head, said stroke adjustment rod extending into said shot cylinder means to limit said stroke of shot cylinder means.

4. The metal delivery system of claim 3, wherein said fine volume control means includes a threaded portion on said stroke adjustment rod operably engaging said piston head. whereby said stroke adjustment rod and said piston head are adjustably interconnected.

5. A variable volume metal delivery system for a die casting apparatus comprising:

a shot sleeve having a discharge end and a plunger reciprocable within said sleeve between a retracted position wherein said plunger is away from said discharge end and an extended position wherein said plunger is toward said discharge end, said plunger having a retracted stroke limit and an extended stroke limit, said shot sleeve defining a shot volume between said discharge end and said plunger when in the retracted position;

a shot cylinder having a reciprocable rod extending therefrom and connected to said plunger to provide motive force to said plunger in moving between the retracted position and the extended position;

gross volume control means for changing the retracted stroke limit of said shot cylinder rod and connected plunger between a low-volume retracted stroke position and a high-volume retracted stroke position without varying the extended stroke limit of said plunger, thereby providing gross variation in the shot volume of said shot sleeve; and fine volume control means for providing fine adjustment of the retracted stroke limit of said shot cylinder rod and connected plunger in the low-volume position and the high-volume position without varying the extended stroke limit of said plunger, thereby providing fine variation in the shot volume of said shot sleeve.

6. The metal delivery system of claim 5, wherein said gross volume control means includes a stroke adjustment rod extending into said shot cylinder to limit movement of said shot cylinder rod.

7. The metal delivery system of claim 6, wherein said gross volume control means further includes:

a volume control cylinder;

a piston head reciprocable within said volume control cylinder and connected to said stroke adjustment rod; and hydraulic means for reciprocating said piston head and said stroke adjustment rod between a low-volume position defining the low-volume retracted stroke limit of said shot cylinder rod and said plunger and a high-volume position defining the high-volume retracted stroke limit of said shot cylinder rod and said plunger.

8. The metal delivery system of claim 7, wherein said fine volume control means includes a threaded portion of said stroke adjustment rod that is engaged with a threaded portion of said volume control cylinder piston head, whereby said stroke adjustment rod and said volume control cylinder piston head are adjustably interconnected.

9. The metal delivery system of claim 8, wherein said volume control cylinder includes a neck surrounding said stroke adjustment rod and adapted to mount to said shot cylinder.

10. An improved metal delivery system for a die casting apparatus, said system including a die assembly, a shot sleeve connected to said die assembly, a plunger reciprocable within said shot sleeve, and a shot cylinder for extending and retracting said plunger, and limit means for limiting the stroke of said plunger wherein the improvement comprises said limit means comprising:

a volume control cylinder connected to said shot cylinder;

a stroke adjustment rod extending from said volume control cylinder and operably engaging said shot cylinder to limit the stroke of said shot cylinder; and means for actuating said volume control cylinder to move said stroke adjustment rod between a low-volume position defining a first stroke of said shot cylinder and a high-volume position defining a second stroke of said shot cylinder.

11. The metal delivery system of claim 10, wherein said volume control cylinder includes a piston, and further wherein said stroke adjustment rod includes a threaded portion threadably engaged with said piston head.

* * * * *

UNITED STATES PATENT AND TRADEMARK OFFICE

CERTIFICATE OF CORRECTION

PATENT NO. : 5,630,463

DATED : May 20, 1997

INVENTOR(S) : Dennis S. Shimmell

It is certified that error appears in the above-indentified patent and that said Letters Patent is hereby corrected as shown below:

Column 7, Claim 1, Line 37:
"position" should be --positions--

Column 7, Claim 3, Line 43:
"claim 1" should be --claim 2--

Signed and Sealed this

Twenty-sixth Day of August, 1997

*Attest:*

Bruce Lehman

BRUCE LEHMAN

*Attesting Officer*

*Commissioner of Patents and Trademarks*